United States Patent [19]

Ogasawara

[11] 4,150,507

[45] Apr. 24, 1979

[54] TOY FOR LOADING A VEHICLE

[75] Inventor: Toyotsugu Ogasawara, Tokyo, Japan

[73] Assignee: Tomy Kogyo Co., Inc., Tokyo, Japan

[21] Appl. No.: 802,569

[22] Filed: Jun. 1, 1977

[30] Foreign Application Priority Data

Jun. 4, 1976 [JP] Japan ..... 51-72814

[51] Int. Cl.[2] ..... A63H 15/02

[52] U.S. Cl. ..... 46/40; 46/116; 46/100; 46/103

[58] Field of Search ..... 46/40, 116, 100, 103

[56] References Cited

U.S. PATENT DOCUMENTS

| | | | |
|---|---|---|---|
| 2,017,616 | 10/1935 | Cuff | 46/40 |
| 2,463,397 | 3/1949 | Krebs | 46/40 |
| 2,973,604 | 3/1961 | Dogirolamo | 46/40 |
| 3,466,791 | 9/1969 | Einfalt | 46/40 |
| 3,562,950 | 2/1971 | Genin | 272/31 R |
| 3,633,308 | 1/1972 | Yang | 46/261 |
| 3,667,154 | 6/1972 | Aoki | 46/40 |
| 3,721,035 | 3/1973 | Goldbarb | 46/40 |
| 3,751,849 | 8/1973 | Goldfarb | 46/40 |
| 3,854,716 | 12/1974 | Spiegel | 272/31 R |

*Primary Examiner*—Louis G. Mancene
*Assistant Examiner*—Robert F. Cutting
*Attorney, Agent, or Firm*—Edward D. O'Brian

[57] ABSTRACT

The invention set forth pertains to a toy in which a vehicle is moved past one side of a leading station as an object is transferred from the loading station to the vehicle. An inclined ramp is located on the loading station; a carrier is movably mounted on the ramp so as to be capable of being elevated from adjacent to the lower end of the ramp to adjacent to the upper end of the ramp. This carrier includes a platform which supports the object as the carrier is elevated along the ramp. The vehicle is moved along the side of the loading station so as to pass the lower end of the ramp and then to continue toward and beyond the upper end of the ramp, and is provided with a shelf at such a height as to be capable of receiving the object on the platform as the carrier is elevated along the ramp. The carrier and the vehicle are provided with structures which engage one another as the vehicle is so moved so that the vehicle serves to move the carrier along the ramp.

9 Claims, 4 Drawing Figures

TOY FOR LOADING A VEHICLE

CROSS-REFERENCE TO RELATED APPLICATIONS

This application relates to the subject matter which is sought and claimed in the co-pending U.S. patent application Ser. No. 759,648, filed Jan. 17, 1977, in the name of Toyotsugu Ogasawara.

BACKGROUND OF THE INVENTION

This invention pertains to a new and improved toy for loading a vehicle as the vehicle moves past a loading station. It is possible to refer to such toys as "transfer" toys since they transfer such an object from a loading station to a vehicle.

Toys which are most closely related to the toys of the present invention are commonly utilized as parts of composite toys constructed so as to include an endless track having an unloading station or structure for removing an object from a vehicle at one side of the track and a chute for conveying such an object to a loading station on the other side of the track where the object is loaded on the vehicle as the vehicle moves around the track. Such toys are commonly constructed so that the vehicle is physically stopped at the loading station so as to power an appropriate attention getting mechanism at the time the object is located upon the vehicle.

Toys of this type are considered to be most commonly utilized with such an object constructed as a simulated figurine consisting of a body and a ball rotatably mounted at the bottom of the body so as to extend therefrom. Such figurings are commonly referred to as "ball people". They are normally constructed so as to be capable of moving through the action of gravity along an inclined surface so as to follow the incline of such a surface. They are also of such a character as to be capable of being moved along a horizontal surface as a result of force being applied to their bodies.

It is commonly recognized that transfer toys as are indicated in the preceding discussion hold a great deal of fascination with comparatively young children. One of the problems in connection with the prior toys of the type noted has concerned the problem of how to design a transfer mechanism for transferring an object from a loading platform to a moving vehicle which is simple, inexpensive, comparatively easy to construct, and reliable. Another problem has involved how to design a toy as indicated which has these characteristics and yet which is of such a nature that a child may manipulate the toy to a degree so as to achieve either a loading or an unloading action in such a manner as to simulate the child's imagination.

BRIEF SUMMARY OF THE INVENTION

A broad objective of the present invention is to provide new and improved toys for loading a vehicle as the vehicle moves past a loading station. The invention is intended to provide toys as indicated which overcome problems encountered with prior related toys as are indicated in the preceding discussion. Thus the invention is intended to provide transfer toys as noted which are simple, inexpensive to construct, reliable in operation, and effective in simulating a child's mind as used. Further objectives of this invention will be apparent from a detailed consideration of the remainder of this specification and the accompanying drawing.

In accordance with this invention a toy including a loading station, a vehicle capable of moving past and adjacent to one side of the loading station, and an object which is adapted to be transferred from the loading station to the vehicle when the vehicle is adjacent to the loading station includes the improvement which comprises: an inclined ramp located on the loading station adjacent to said side thereof, a carrier located on the inclined ramp so as to be capable of being moved from adjacent to the lower end thereof to adjacent to the upper end thereof, the carrier including a platform located thereon which is adapted to support the object as the carrier is elevated along said ramp, the vehicle being capable of moving along said side of said loading station so as to initially pass the lower end of the ramp and to continue past said upper end of said ramp, a shelf located on the vehicle at such a height as to be capable of receiving an object from the platform as the carrier is elevated along the ramp and cooperating motion coupling means located on the vehicle and on the carrier which engage one another as the vehicle moves past and adjacent to said side of said loading station for elevating the carrier to a position such that the object can move on to the shelf.

BRIEF DESCRIPTION OF THE DRAWING

Because of the nature of the invention it is considered that it is best more fully explained by referring to the accompanying drawing in which.

Figure 1:
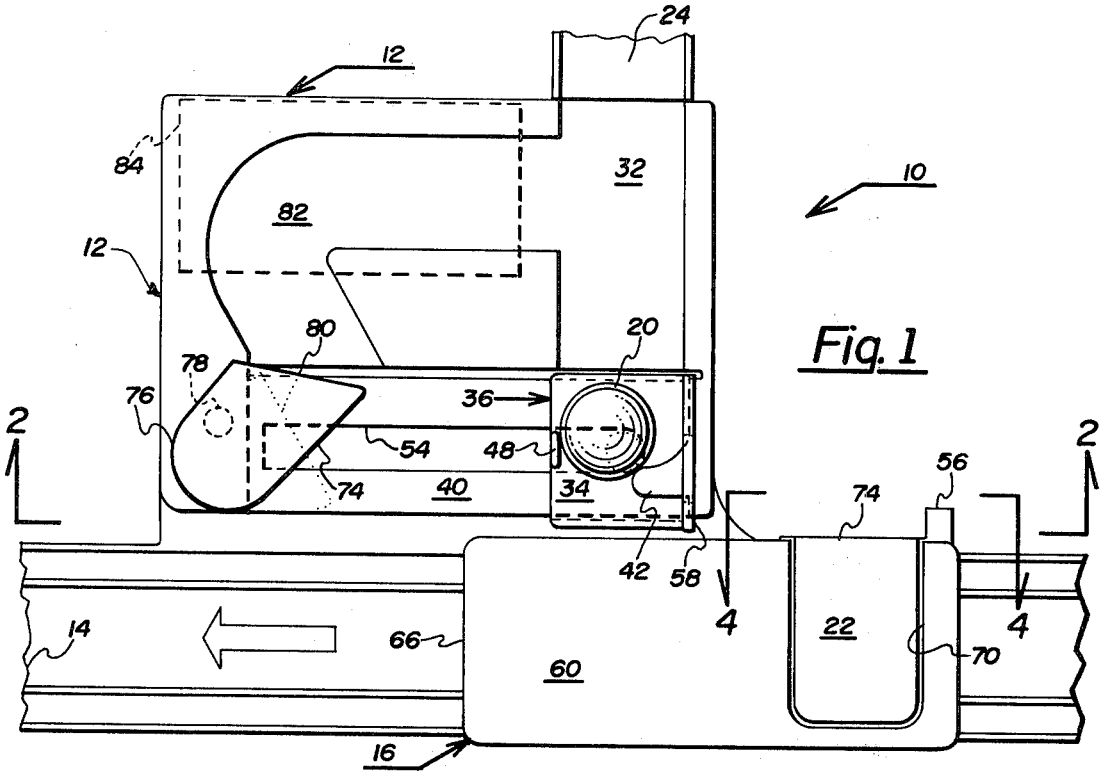
FIG. 1 is a top plan view of a presently preferred embodiment or form of a toy in accordance with this invention.
Figure 2:
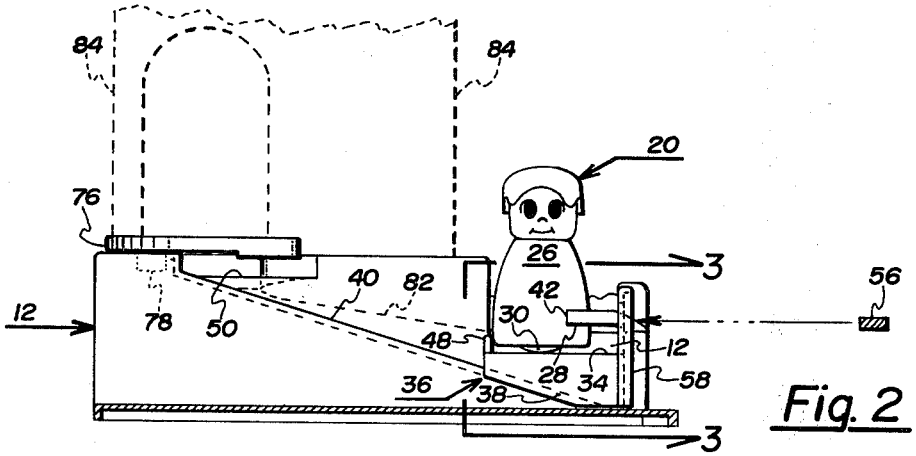
FIG. 2 is a cross-sectional view taken at line 2—2 of FIG. 1 showing a side of the loading station in elevation.
Figure 4:
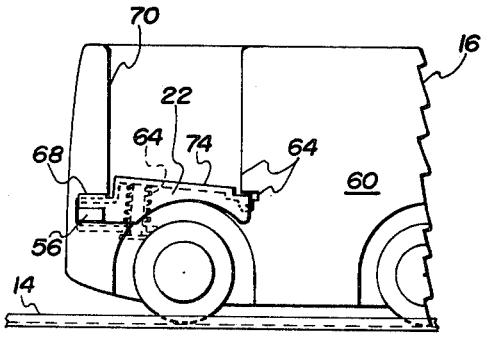
FIG. 4 is a partial cross-sectional view, partially broken away, taken at line 4—4 of FIG. 1.
Figure 3:
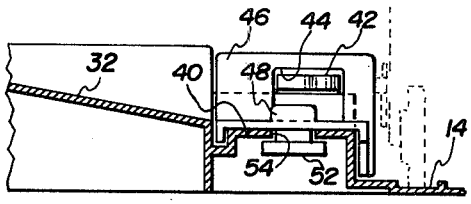
FIG. 3 is a partial cross-sectional view taken at line 3—3 of FIG. 2.

The toy illustrated embodies certain operative concepts or principles as are set forth and defined in the appended claims forming a part of this specification. It is considered obvious that these concepts or principles can be embodied in a variety of somewhat differently constructed and/or differently appearing toys through the use of routine design skill such as is found in the toy industry.

DETAILED DESCRIPTION

In the drawing there is shown a toy 10 of the present invention which includes a loading station 12 which is located adjacent to a conventional track 14. This track 14 is adapted to guide the movement of a vehicle 16 so that such a vehicle moves past a side 18 of the loading station 12. Such a vehicle 16 may be a self-propelled simulated automotive vehicle, a car on a train set, or the like. Normally the toy 10 will be utilized with additional track 14 (not shown) which will guide the vehicle 16 around an endless path including an unloading station (not shown) which will serve to remove an object 20 from a shelf 22 on the vehicle 16 in a known manner so that such an object 20 will move along an inclined chute 24 back to the loading station 12 as the vehicle 16 moves toward this loading station 12.

In effect the toy 10 may be referred to as a transfer toy for transferring the object 20 from the loading station 12 to the vehicle 16 as the toy 10 is utilized. This toy 10 is considered to be quite desirable and unique in that the mechanism used does not require the vehicle 16 to be stopped adjacent to the loading station 12 as it is used. A significant feature making this possible in the toy 10 and contributing materially to the play value of the toy relates to the character of the object 20 used.

Preferably the object 20 is constructed as a simulated figurine having a body 26 rotatably holding at its lower end or bottom 28 a comparatively heavy ball 30 which extends from the body 26 in such a manner as to support the body 26. In effect the ball 30 serves as a wheel or wheel means. Figurines corresponding to the object 20 are known and are capable of moving through the action of gravity along an inclined surface so as to follow such a surface. They are also capable of being pushed so as to move along a horizontal surface. Figurines corresponding to the object 20 are referred to as so-called "ball-people". They are considered to have significant play value in a wide variety of different toys.

With the toy 10 when such an object or figurine 20 moves along a chute 24 from an unloading station (not shown) as indicated in the preceding it moves onto an inclined chute 32 on the loading station 12 in effect forming a continuation or extension of the chute 24 downwardly toward a platform 34 on a carrier 36. This carrier 36 is normally located at the lower end of an inclined ramp 40 on the station 12 adjacent to and alongside of the side 18. The object or figurine 20 is prevented from moving off of the platform 34 as it passes from the chute 32 by virtue of a stop member 42 on the station 12 projecting through an opening 44 in a vertically extending wall 46 forming a part of the carrier 36. This wall 46 may be referred to as a back wall and extends upwardly from the platform 34. A similar, smaller upwardly extending stop member 48 may be located on the platform 34 remote from the wall 46 on the portion of the platform 34 closest adjacent to the upper end 50 of the ramp 40.

The carrier 36 includes a generally T-shaped retainer 52 which fits through a slot 54 in the ramp 40 extending between the lower and upper ends 38 and 50, respectively. This retainer 52 and the slot 54 mount the carrier 36 in such a manner that it cannot be removed from the loading station 12. Preferably the ramp 40 is sufficiently steep so that the carrier 36 will move backwardly by the action of gravity toward the lower end 38 after being moved or elevated from adjacent to this lower end 38 toward the upper end 50.

With the toy 10 the carrier 36 is adapted to be so elevated by engagement of a projection 56 on the vehicle 16 abutting against a vertically extending edge 58 of the wall 46 as the vehicle 16 is moved along the track 14 from adjacent to the lower end 38 to adjacent to the upper end 50. During such movement the projection 56 slides along the edge 58 until such time as this projection 56 is released from engagement by the edge 58 when the carrier 36 is adjacent to the upper end 50.

Althouth it would be possible to construct the vehicle 16 in such a manner that the projection 56 is located on the body 60 of the vehicle 16 so as not to be movable relative to the body 60 it is preferred to locate this projection 56 on the shelf 22 so that this projection 56 extends from the shelf 22. When this is done it is preferred to mount the shelf 22 on pivots 62 connecting it with the body 60 and to tend to bias the shelf 22 upwardly through the use of a small spring 64 so that the shelf 22 normally pivots a limited amount toward the front 66 of the body 60 of the vehicle 16.

The amount that the shelf 22 can be pivoted upwardly may be conveniently limited by engagement of the projection 56 with a portion 68 of the body 16. Preferably this body is formed so as to include an internal wall structure or notch 70 surrounding the principal portion of the shelf 22 in such a manner that an object or figurine 20 will be held on the shelf 22 as the vehicle 16 moves. If desired a small beveled lip 72 may be located on the shelf 22 so as to minimize any chances of an object or figurine moving off of the shelf 22 as the vehicle 16 moves.

As the toy 10 is utilized and as such an object or figurine 20 is in position upon the platform 34 the action of the projection 56 against the edge 58 as the vehicle 16 moves will tend to push the carrier 36 along the ramp 40. When the platform 34 reaches approximately the level of the shelf 22 the object or figurine 20 located upon the platform will come in contact with a diverting edge 74 on a guide 76. This edge 74 extends diagnally across the ramp 40 from adjacent to the side 18 and from adjacent to the upper end 50. The contact between the edge 74 and the object or figurine 20 will push such object or figurine 20 so that it will move from the platform 34 on to the shelf 22 as the platform 34 reaches a height slightly above the height of the shelf 22.

As this happens the projection 56 will be released from contact with the edge 58 by passing beneath this edge 58. Such release action will be rather fast with the toy 10 achieving a positive release because the weight of the object or figurine 20 will compress the spring 64 to a sufficient extent so that the shelf 22 pivots on the pivot 62 so as to rapidly bring the projection 56 underneath the edge 58. As the vehicle 16 is released in this manner it will pass so as to again be in a position to pick up an object or figurine 20 in the manner described.

One of the features which is considered to contribute to the play value of the toy lies in the fact that the guide 76 is mounted on the loading station 12 by means of a pivot 78 so that it can be turned between a position in which the edge 74 extends across the ramp 40 as indicated and another position in which another diverting edge 80 extends across this ramp in such a position as to tend to direct an object or figurine 20 on to an inclined runway 82. This runway 82 is formed in the loading station 12 so as to receive the object or figurine 20 as the carrier 36 is moved upwardly through the operation of the vehicle 16. This runway 82 leads back to the chute 32 which will convey an object or figurine 20 moved in the manner indicated back to the platform 34 on the carrier 36.

In order to achieve this mode of operation the length and slope of the runway 82 and the chute 32 must be correlated with the rate of movement of the object or figurine 20 so that the carrier 36 has time to move back to adjacent to the lower end 38 of the ramp 40 prior to the object or figurine 20 moving to adjacent to this lower end 38 of the ramp 40. If desired the runway 82 may be surmounted by a simulated building 84 (shown in phantom) located on the loading station 12 so as to simulate movement into and out of a building as the toy 10 is used.

Obviously the precise toy 10 can be modified in a number of ways. The guide 76 is in effect a guide means for pushing the object or figurine 20. The projection 56 and the edge 58 may be regarded as cooperating motion coupling means for elevating the carrier 36 because of the manner in which the toy 10 functions. If desired reliance on gravity as a way of returning the carrier 36 to adjacent to the lower end 38 can be avoided by connecting this carrier 36 to the loading station 12 by a spring (not shown) which is stretched as the carrier 36 is moved upwardly. Various different modifications of this type may be easily made in the toy 10 through the use or exercise of routine engineering skill.

I claim:

1. A toy including a loading station, a vehicle capable of moving past and adjacent to one side of said loading station and an object which is adapted to be transferred from said loading station to said vehicle when said vehicle is adjacent to said side of said loading station in which the improvement comprises:

an inclined ramp located on said loading station adjacent to said side thereof, a carrier located on said inclined ramp so as to be capable of being elevated from adjacent to the lower end thereof to adjacent to the upper end thereof, said carrier including a platform located thereon which is adapted to support said object as said carrier is elevated along said ramp, said vehicle being capable of moving along said side of said loading station so as to initially pass said lower end of said ramp and to continue past said upper end of said ramp, a shelf located on said vehicle at such a height as to be capable of receiving said object from said platform as said carrier is elevated along said ramp, and cooperating motion coupling means located on said vehicle and on said carrier which engage one another as said vehicle moves past and adjacent to said side of said loading station for elevating said carrier to a position such that said object can move to said shelf.

2. A toy as claimed in claim 1 including:

guide means located on said loading station for engaging said object when said object is located on said platform and said carrier is elevated from adjacent to said lower end toward said upper end so as to move said object off of said platform and on to said shelf as said vehicle moves past said side of said loading station and as said carrier is elevated along said ramp.

3. A toy as claimed in claim 2 wherein:

said guide means includes a diverting edge extending diagnally across said ramp located so as to contact said object as said carrier is elevated along said ramp so as to deflect said object off of said platform on to said shelf.

4. A toy as claimed in claim 1 wherein:

said object is a figurine constructed so as to include a body and a ball carried by said body and extending from the lower extremity thereof, said ball being capable of rotating with respect to said body and serving as a wheel means enabling said figurine to move by the action of gravity so as to follow an inclined surface.

5. A toy as claimed in claim 1 wherein:

said loading station includes an inclined chute for conveying said object on to said platform from a side thereof remote from said side of said loading station.

6. A toy as claimed in claim 5 wherein:

said loading station includes a stop member located thereon extending over said platform adjacent to said side of said loading station when said carrier is adjacent to said lower end of said ramp for holding said object from movement off of said platform when said object moves along said inclined chute on to said platform.

7. A toy as claimed in claim 5 wherein:

said loading station includes an inclined runway having an upper end located adjacent to the upper end of said ramp and a lower end leading on to said chute, adjustable guide means located on said loading station for engaging said object when said object is located on said platform and when said carrier is elevated from adjacent to said lower end toward said upper end so as to move said object off of said platform, said guide means being capable of being adjusted so as to engage said object so as to either push said object on to said shelf as said vehicle moves past said side of said loading station or to push said object on to said upper end of said runway as said vehicle moves past said side of said loading station.

8. A toy as claimed in claim 7 wherein:

said guide means includes two diverting edges and is capable of being positioned so that either of said diverting edges extends diagnally across said ramp so as to contact said object as said carrier is elevated along said ramp so as to deflect said object off of said platform.

9. A toy as claimed in claim 1 wherein:

said object is a figurine constructed so as to include a body and a ball carried by said body and extending from the lower extremity thereof, said ball being capable of rotating with respect to said body and serving as a wheel means enabling said figurine to move by the action of gravity so as to follow an inclined surface, said loading station includes an inclined chute for conveying said object on to said platform from a side thereof remote from said side of said loading station, said loading station includes a stop member located thereon extending over said platform adjacent to said side of said loading station when said carrier is adjacent to said lower end of said ramp for holding said object from movement off of said platform when said object moves along said inclined chute on to said platform, said loading station includes an inclined runway having an upper end located adjacent to the upper end of said ramp and a lower end leading on to said chute, adjustable guide means located on said loading station for engaging said object when said object is located on said platform and when said carrier is elevated from adjacent to said lower end toward said upper end so as to move said object off of said platform, said guide means being capable of being adjusted so as to engage said object so as to either push said object on to said shelf as said vehicle moves past said side of said loading station or to push said object on to said upper end of said runway as said vehicle moves past said side of said loading station, said guide means includes two diverting edges and is capable of being positioned so that either of said diverting edges extends diagnally across said ramp so as to contact said object as said carrier is elevated along said ramp so as to deflect said object off of said platform.

* * * * *